US006223496B1

(12) United States Patent
Mardirosian

(10) Patent No.: US 6,223,496 B1
(45) Date of Patent: May 1, 2001

(54) METHOD AND APPARATUS FOR PLANK TOP INSTALLATION FOR A DECK

(76) Inventor: Harry Mardirosian, 1055 Bluff Side, St. Louis, IL (US) 62236

( * ) Notice: Subject to any disclaimer, the term of this patent is extended or adjusted under 35 U.S.C. 154(b) by 0 days.

(21) Appl. No.: 09/304,556

(22) Filed: May 4, 1999

Related U.S. Application Data

(60) Provisional application No. 60/103,895, filed on Oct. 31, 1998, and provisional application No. 60/120,265, filed on Feb. 16, 1999.

(51) Int. Cl.[7] ..... E04D 15/00

(52) U.S. Cl. ..... 52/749.11; 52/745.6; 52/747.1; 52/DIG. 1; 156/527

(58) Field of Search ..... 52/749.1, 745.6, 52/747.1, DIG. 1; 242/615.2, 615.3; 156/527, 574; 114/84, 85, 119, 263

(56) References Cited

U.S. PATENT DOCUMENTS

| | | | | |
|---|---|---|---|---|
| 4,567,825 | * | 2/1986 | Twina | 101/269 |
| 4,818,329 | * | 4/1989 | Tutas et al. | 156/391 |
| 4,990,214 | * | 2/1991 | Heil et al. | 156/527 |
| 5,105,935 | * | 4/1992 | Kohl | 198/781 |
| 5,110,401 | * | 5/1992 | Huang | 156/527 |
| 5,269,871 | * | 12/1993 | Longworth et al. | 156/527 |
| 5,613,339 | * | 3/1997 | Pollock | 52/731.1 |
| 5,735,097 | * | 4/1998 | Cheyne | 52/489.1 |
| 5,758,456 | * | 6/1998 | Case | 52/177 |
| 5,904,011 | * | 5/1999 | Biro | 52/177 |
| 5,968,311 | * | 10/1999 | Zupon, Jr. et al. | 156/577 |
| 6,018,925 | * | 2/2000 | Biro | 52/731.1 |
| 6,062,844 | * | 5/2000 | Biro | 425/327 |

* cited by examiner

*Primary Examiner*—Jerry Redman
*Assistant Examiner*—Bruce A. Lev
(74) *Attorney, Agent, or Firm*—Kevin L. Klug

(57) ABSTRACT

A method and apparatus for plank top installation for a deck comprising two tools and their method of use. The method is capable of attaching a top plank material and a bottom plank material, typically the "Teck Deck" system from Heritage Vinyl Products, together in a quick and non-destructive manner without the use of hammers or mallets. The method comprises the use of a first plank top installation tool for placing most of said planks together and then uses a plank top end installation tool to place the remaining unattached planks. Each tool comprises a series of rollers and force application components for applying the necessary force between a top and bottom plank for attachment of said planks.

15 Claims, 15 Drawing Sheets

METHOD AND APPARATUS FOR PLANK TOP INSTALLATION FOR A DECK

This application claims priority of Provisional Patent Applications 60/103,895 filed Oct. 31, 1998 and 60/120,265 filed Feb. 16, 1999.

BACKGROUND OF THE INVENTION

The present invention relates in general to a method and apparatus for installing planks for decking material and more particularly, to a set of specialty tools and method of use for installation, placement and setting of flexible planking material for decks. The apparatus of the present invention represents a unique, lightweight, and portable tool set and method of use for installation of said flexible top decking material.

A vinyl deck construction system which includes a sandwich of a bottom and top plank portion is currently available from Heritage Vinyl Products of Macon, Miss. The vinyl deck plank construction comprises a bottom structural plank member which is placed and secured onto a deck frame and a top flexible plank decking material which is placed, pressed, and snapped into place on said bottom decking. This unique deck material form and style which is provided by Heritage Vinyl Products is known as the "Teck Deck" system. It provides a vinyl deck surface which is comprised of a series of planks which are formed from said bottom and top plank decking materials. The top plank snaps onto a set of ears of the bottom plank via the action of a groove within said top plank when the ears on said bottom plank are compressed. No claim is made to the decking materials which are proprietary to Heritage Vinyl Products.

The current method of snapping said top plank onto said bottom plank requires the installer to use a large mallet or hammer. The installer currently places the top planking and decking material onto the bottom plank and proceeds to hammer the top plank into place in order to compress the ears of said bottom plank into the groove of the top plank. This method is extremely time consuming, difficult to perform, and further risks damage to the top and bottom planking material.

The art of the present invention allows for the installation of said top plank onto said bottom plank via the action of a set of specialty installation tools and without the use of mallets or hammers. That is, the apparatus of the present art represents a set of specialty tools which are capable of snapping the top and bottom planks together via the action of a set of specially designed rollers and guides. By the using the special apparatus of the current art, a method has been developed which allows for installation of the top and bottom planking materials while the installer simply walks or crawls behind and pushes the specialty tool apparatus. This method of installation eliminates the risk of damage to the top and bottom decking planks and also provides for a quick and easy installation of said top plank onto said bottom plank.

Accordingly, it is an object of the present invention to provide a method and apparatus for installing a flexible top plank decking material onto a bottom plank decking material, especially for the Teck Deck series of decking materials and any decking materials which are substantially similar, without the use of mallets or hammers.

Another object of the present invention is to provide a method and apparatus for installing a flexible top plank decking material onto a bottom plank decking material which is quick and easy to use without damaging said decking materials and which is substantially capable of use by an installer working from a standing or crawling position.

A further object of the present invention is to provide an apparatus for installing a flexible top plank decking material onto a bottom plank decking material which is portable.

SUMMARY OF THE INVENTION

To accomplish the foregoing and other objects of this invention there is provided a method and apparatus for installing flexible decking planks. The apparatus comprises two roller systems which are described separately but used in conjunction with one another in order to perform the installation method described herein. The first roller system is defined as the plank top installation tool and the second roller system is defined as the plank top end installation tool. The plank top installation tool is used to place and secure substantially all of the flexible plank top onto the bottom plank, whereas the plank top end installation tool is used to place and secure the ends of the plank top. The method of placing said plank top onto said plank bottom first requires use of the plank top installation tool to secure and place most of the plank top and then use of the plank top end installation tool to secure and place the ends of said plank top.

The preferred embodiment of the plank top installation tool comprises a roller and face plate yoke, a face plate, a front roller guide, a pressure roller, a front roller guide axle, a pressure roller axle, and a handle. The face plate is of substantially flat form with ears extending upward to provide a pivoting attachment to the yoke via the front roller guide axle. The yoke acts as the central housing upon which all parts attach directly or indirectly. The bottommost portion of the face plate comprises one or more alignment grooves for proper alignment with and onto the ears of the bottom plank. The face plate along with the front roller guide is attached via the front roller guide axle. The front roller guide acts to guide and align the flexible top plank material under the pressure roller via the one or more roller grooves contained on the front roller guide. The pressure roller is mounted rearward of the front roller guide and serves to press the top plank onto the bottom plank after being fed over the front roller guide. The pressure roller is held in place with the pressure roller axle. The handle attaches to the yoke in order to provide a means by which pressure may be applied to the top plank material through the pressure roller and while the user is in a standing position. The alignment grooves in the face plate further serves to hold the frontmost portion of the plank top installation tool onto the ears of the bottom plank in order to provide a moment arm force onto the pressure roller without raising the face plate from its contact and connection with the bottom plank.

The preferred embodiment of the top plank end installation tool comprises a front pressure roller and a rear roller, a right side plate with one or more guide ears, a left side plate with one or more guide ears, a force application front handle, a force application rear handle, a front spacer bushing, and a rear spacer bushing. In a preferred embodiment, said bushings are held in place by fasteners such as bolts which penetrate both the right side plate and the left side plate and serve as axles. Alternative embodiments may incorporate pins or dowels in place of said bolts. Said front roller is mounted onto said front spacer bushing and said rear roller is mounted onto said rear spacer bushing in such a relation that each are allowed to roll on said bushings. Each of said rollers are slightly shorter in length than the bushing onto which they are mounted in order to ensure free rolling of said rollers. The placement of each of said rollers is such that said guide ears extend below the surface of said rollers and serve to guide the top plank end installation tool on the flexible top plank. Said rollers place a user supplied force on said top plank in order to push said top plank onto said bottom plank and press or snap it into place. It is important to note that although the rollers are mounted on bushings in a preferred embodiment, alternative embodiments may incorporate rollers which simply bear upon the fasteners or bolts which hold them and the side plates together.

In operation of the plank top installation tool, the user first places, aligns and secures the bottommost portion of the face plate containing the alignment grooves onto the interfacing portion of the bottom plank containing the bottom plank ears. Thereafter, the user threads a flexible top plank over the front roller guide and under the pressure roller. With the top plank threaded, the user the presses downward with the handle and begins walking in a forward direction. As the user walks, the top plank hooked portions or grooves are forcibly secured onto the extending ears of the bottom plank or bottom plank ears via the force provided by the pressure roller. Pressure is provided by and onto the pressure roller due to the fact that the unique configuration of the alignment grooves in the face plate serve to hold it onto the ears of the bottom plank and form a moment arm due the force supplied by the handle, thereby providing a downward force onto said pressure roller.

The installation method of the present art is completed by use of the plank top end installation tool. In operation of the plank top end installation tool, the installer first places most of the flexible top plank material with the aforesaid plank top installation tool. After most of the flexible top plank is placed, the installer then places the top plank end installation tool on the end of the top plank which is still unplaced and unsecured with said bottom plank. The installer then contacts the front pressure roller and rear roller with the unsecured top plank end and aligns the guide ears with the edges of said top plank and presses downward while rolling forward to finish the top plank installation. The user supplied force on the force application front handle and force application rear handle serve to provide enough force onto said rollers to secure the flexible top plank onto the bottom plank. After the top plank is fully placed, the user simply lifts the top plank end installation tool off of the top plank and the method of installation is complete.

The installation method of the present invention requires use of both tools described. That is, the plank top installation tool is generally used first, then the installation is completed by using the plank top end installation tool. The apparatus of both tools and the associated components may be manufactured of many types of materials including but not limited to plastic, composites, wood and various metals and their alloys as required by the application. In a preferred embodiment, the plank top installation tool and plates and handles of the plank top end installation tool are manufactured from an aluminum alloy whereas the rollers of the plank top end installation tool are manufactured from a plastic material.

BRIEF DESCRIPTION OF THE DRAWINGS

Numerous other objects, features and advantages of the invention should now become apparent upon a reading of the following detailed description taken in conjunction with the accompanying drawings, in which.

DETAILED DESCRIPTION

Figure 1:
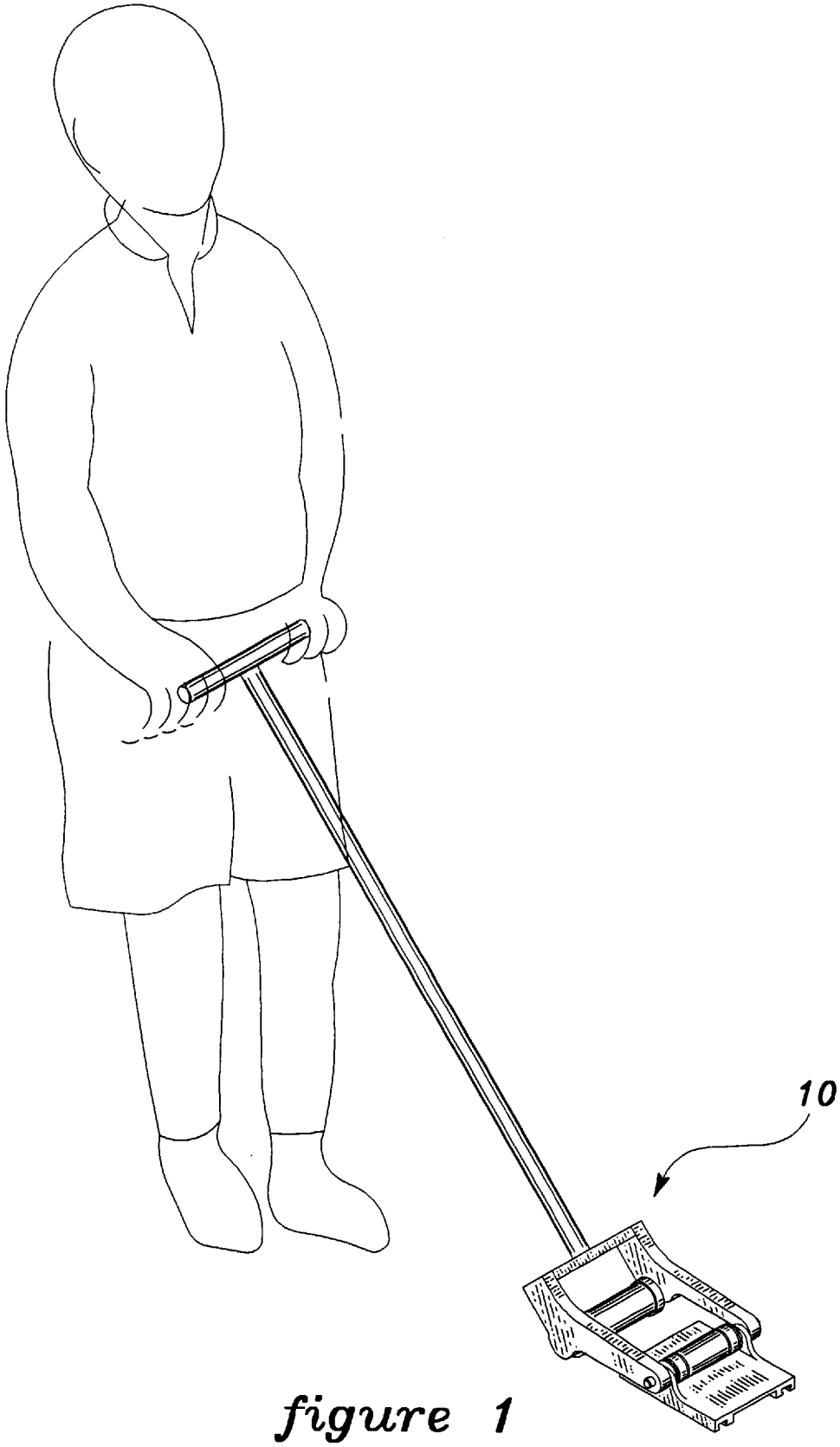
FIG. 1 is a perspective view of the plank top installation tool showing an installer holding the handle and using the apparatus.
Figure 2:
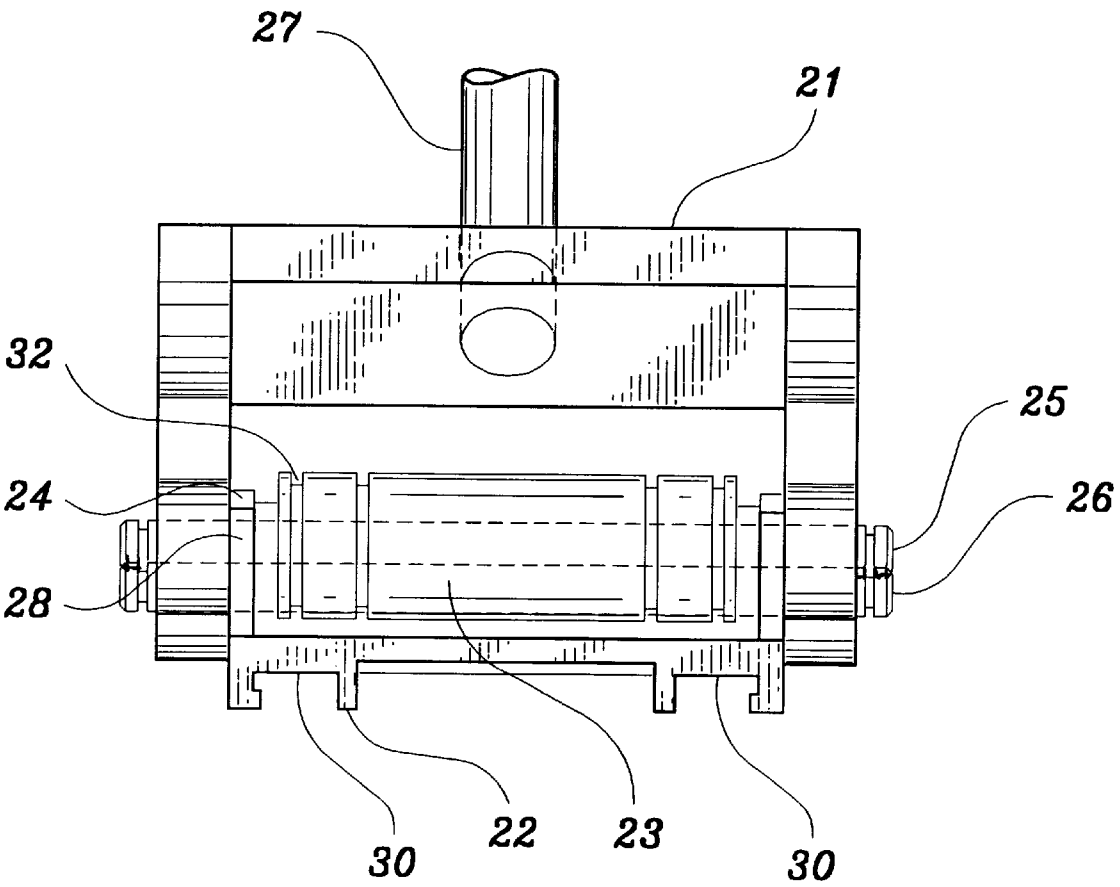
FIG. 2 is a front side plan view of the plank top installation tool.
Figure 3:
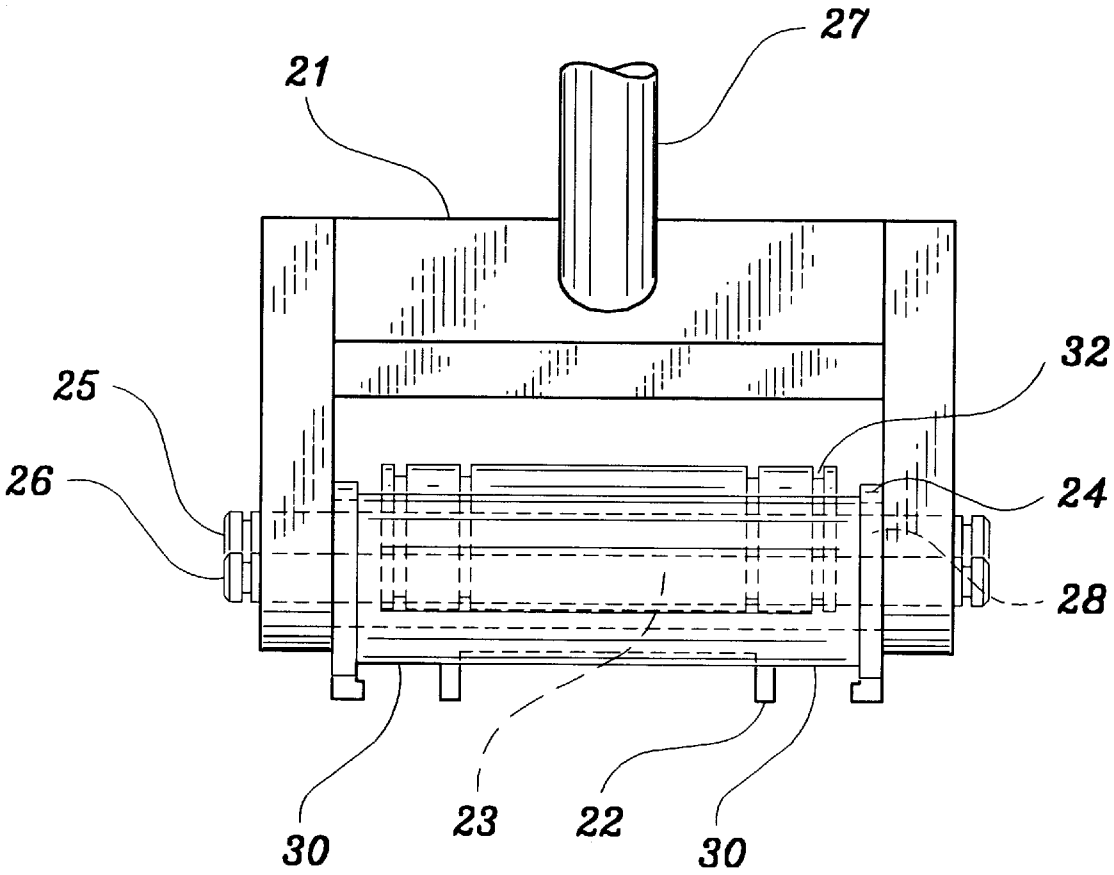
FIG. 3 is a rear side plan view of the plank top installation tool.
Figure 4:
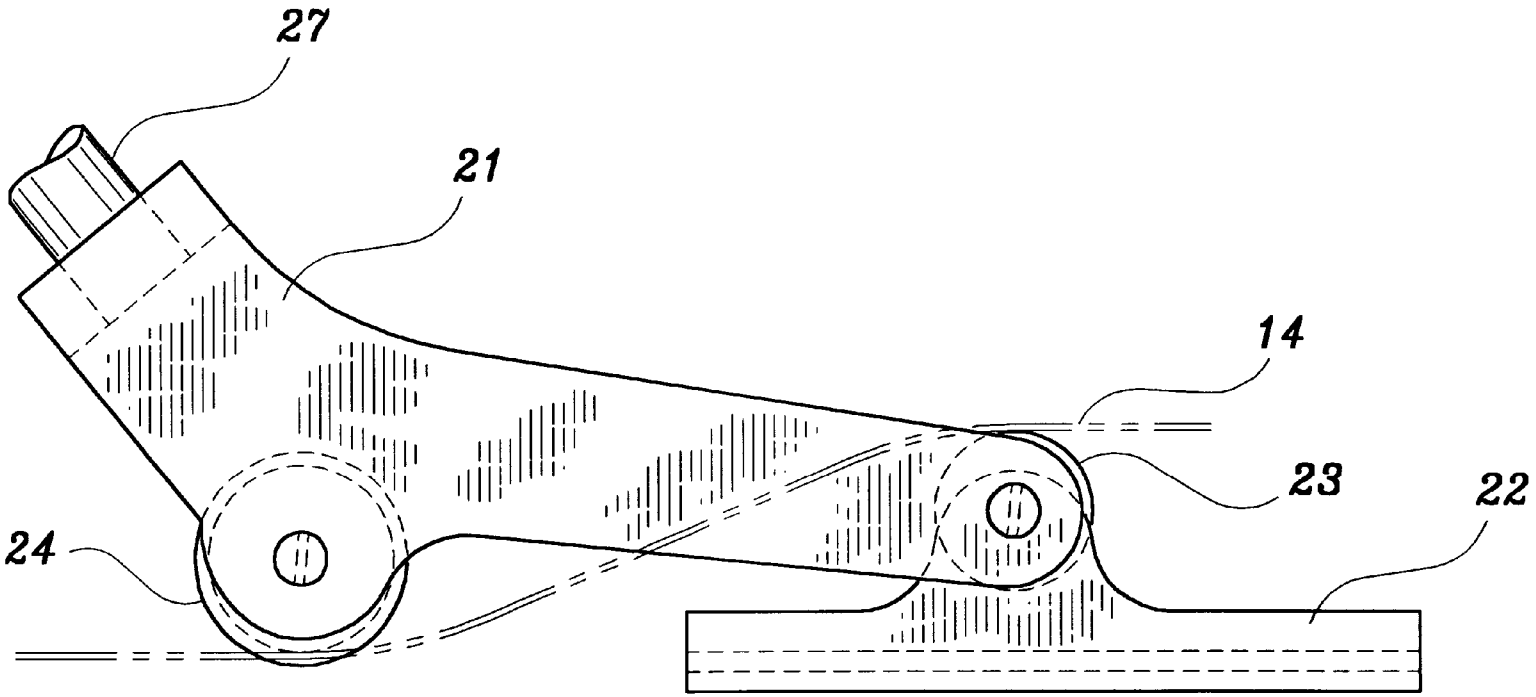
FIG. 4 is a left side plan view of the plank top installation tool which is symmetrical with a right side plan view thereof with a flexible top plank material threaded therethrough.
Figure 5:
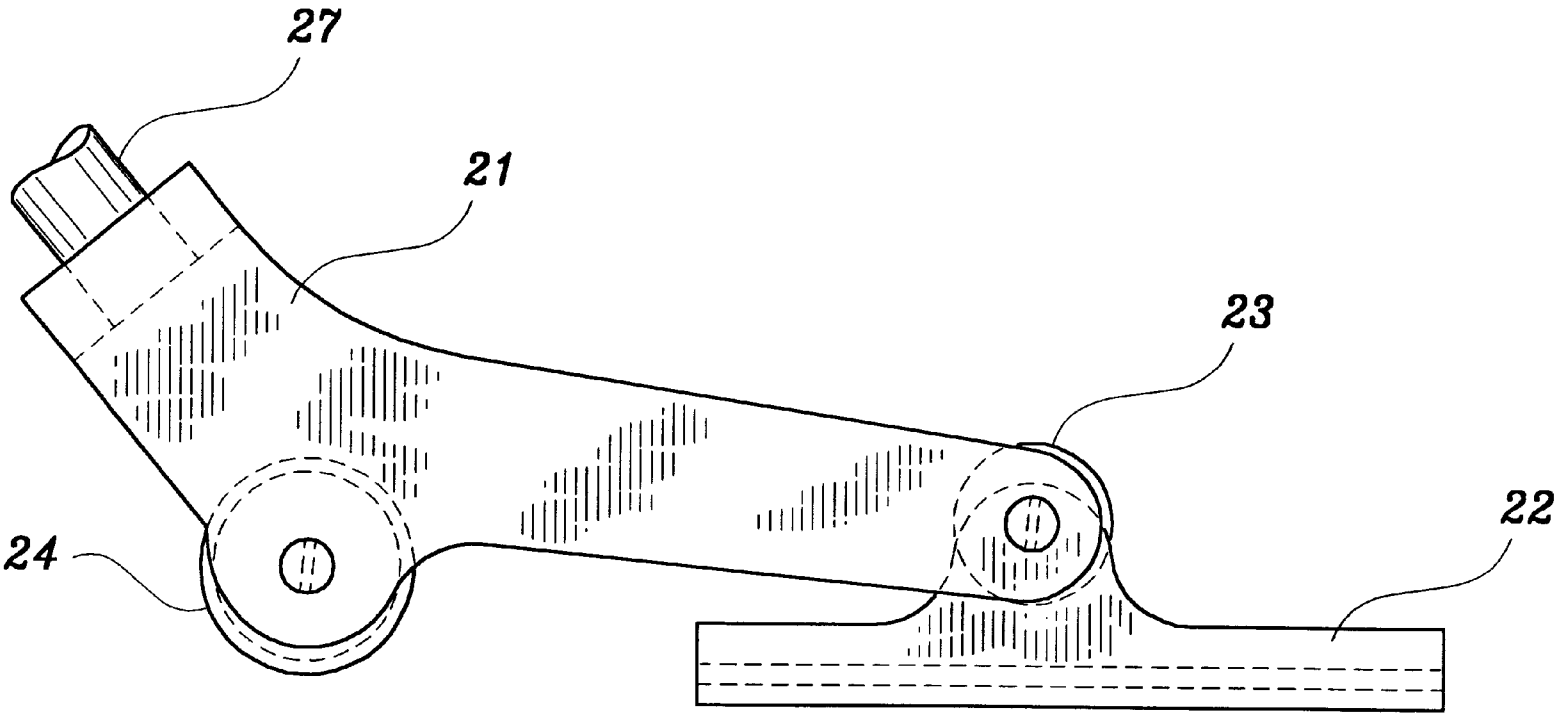
FIG. 5 is a left side plan view of the plank top installation tool which is symmetrical with a right side plan view thereof.
Figure 6:
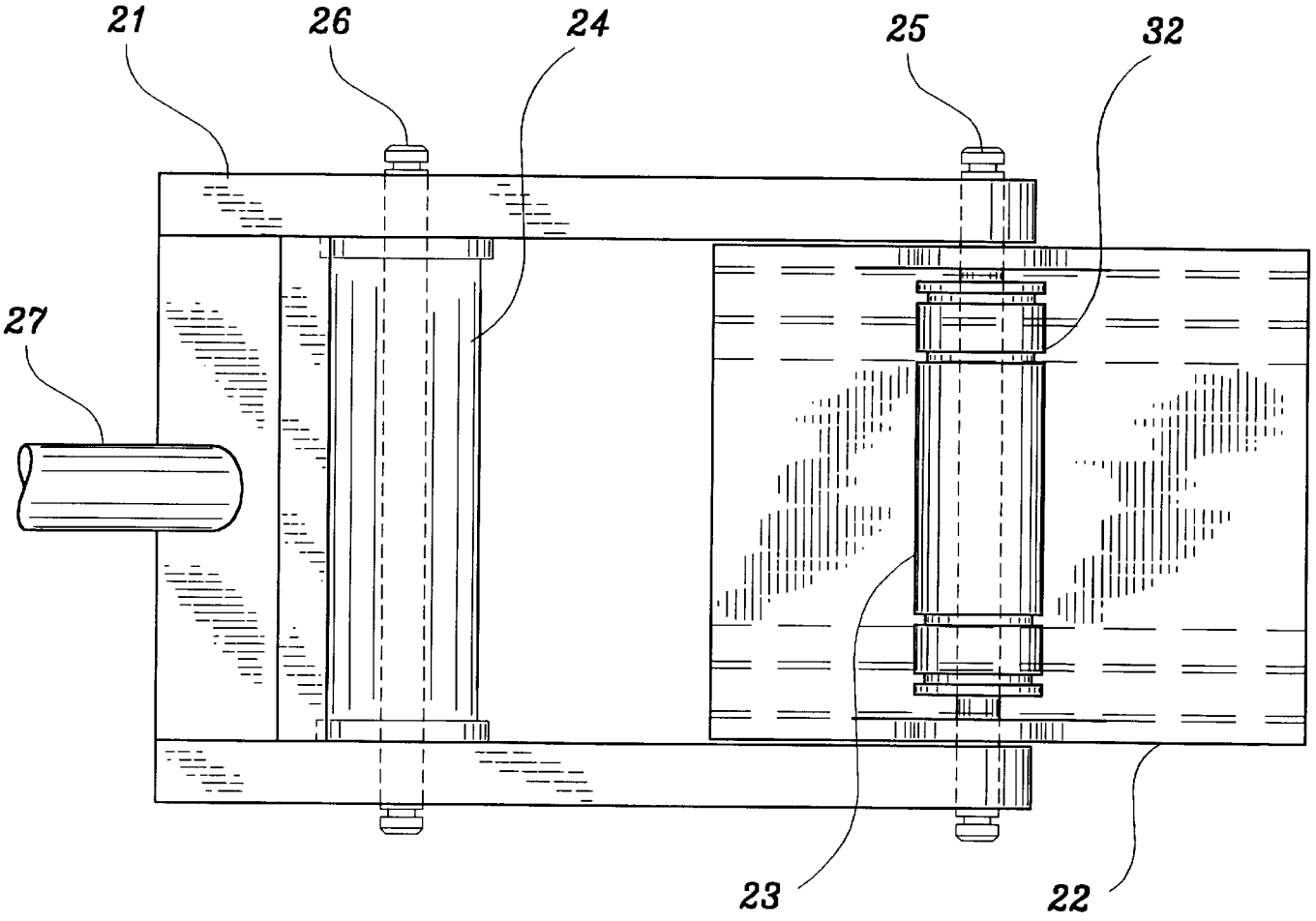
FIG. 6 is a top side plan view of the plank top installation tool.
Figure 7:
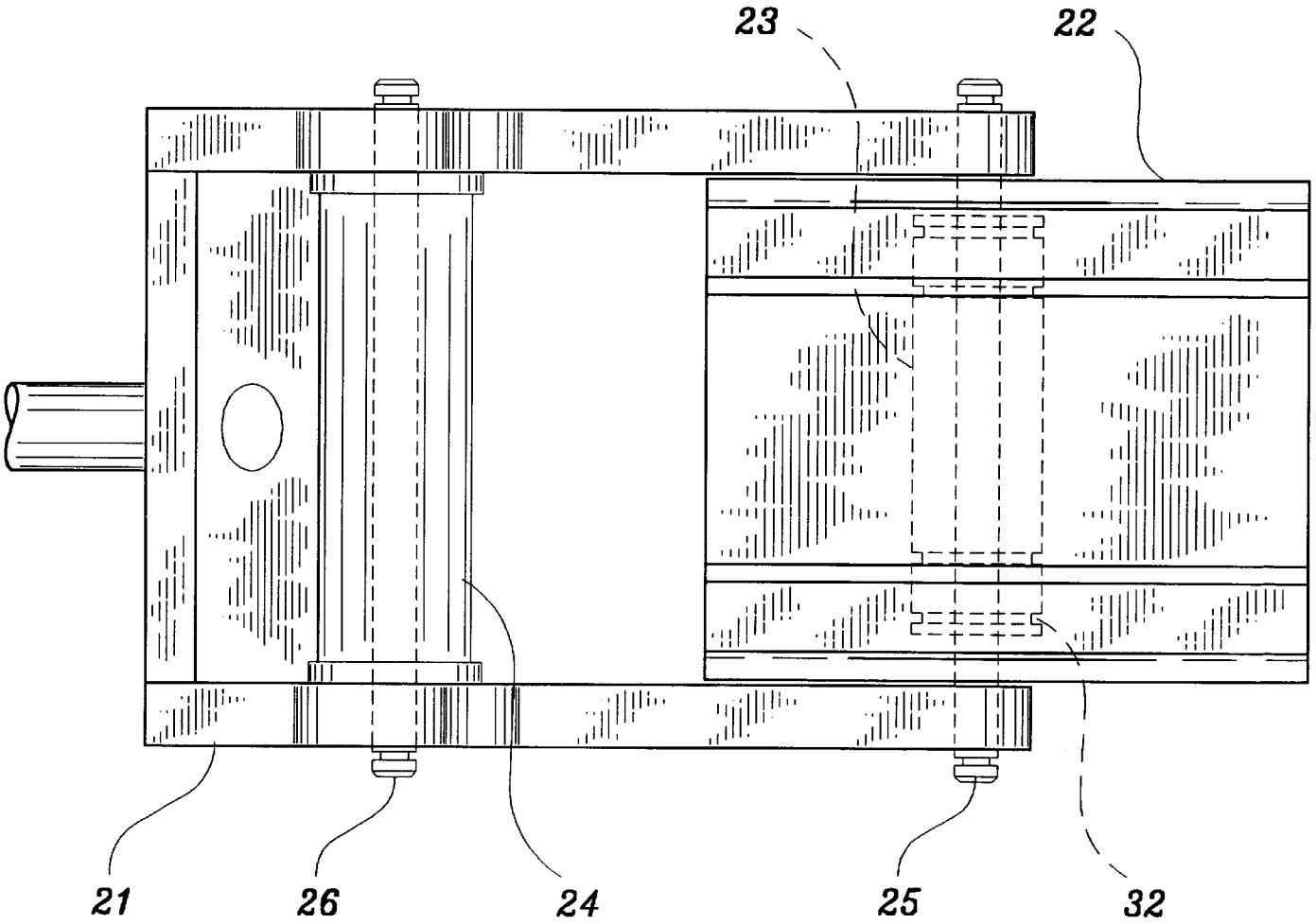
FIG. 7 is a bottom side plan view of the plank top installation tool.
Figure 8:
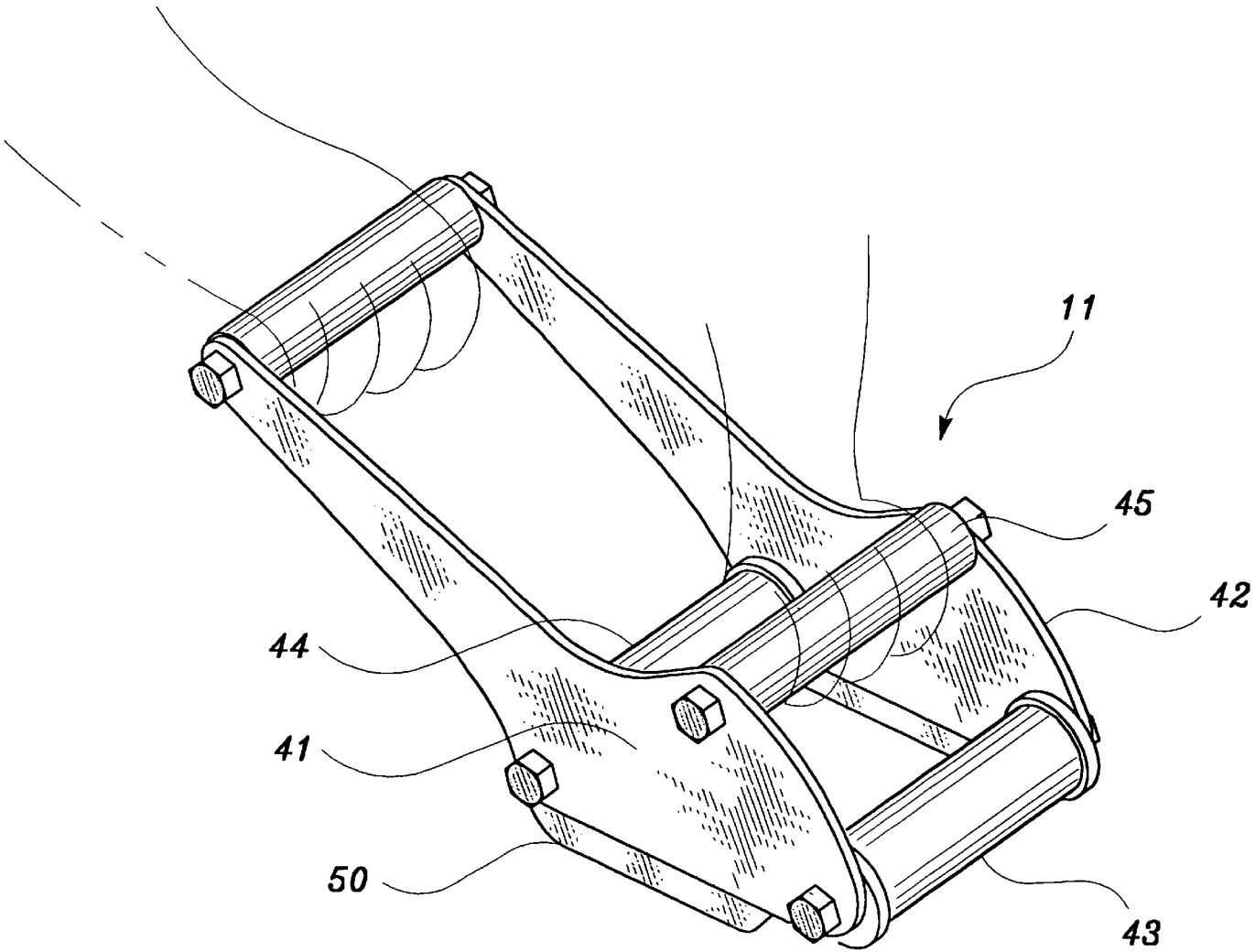
FIG. 8 is a perspective view of the plank top end installation tool showing an installer holding the handles and using the apparatus.
Figure 9:
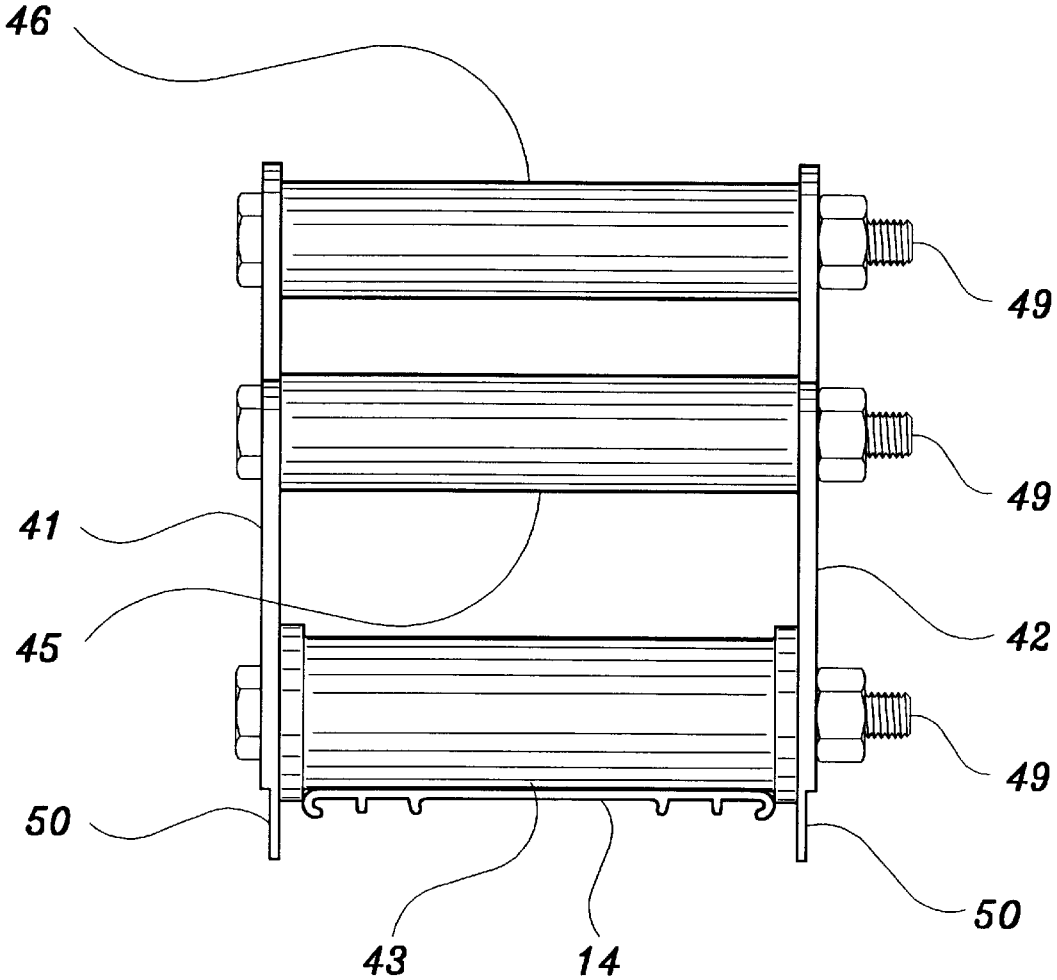
FIG. 9 is a front side plan view of the plank top end installation tool also showing a cross section of top plank material in place.
Figure 10:
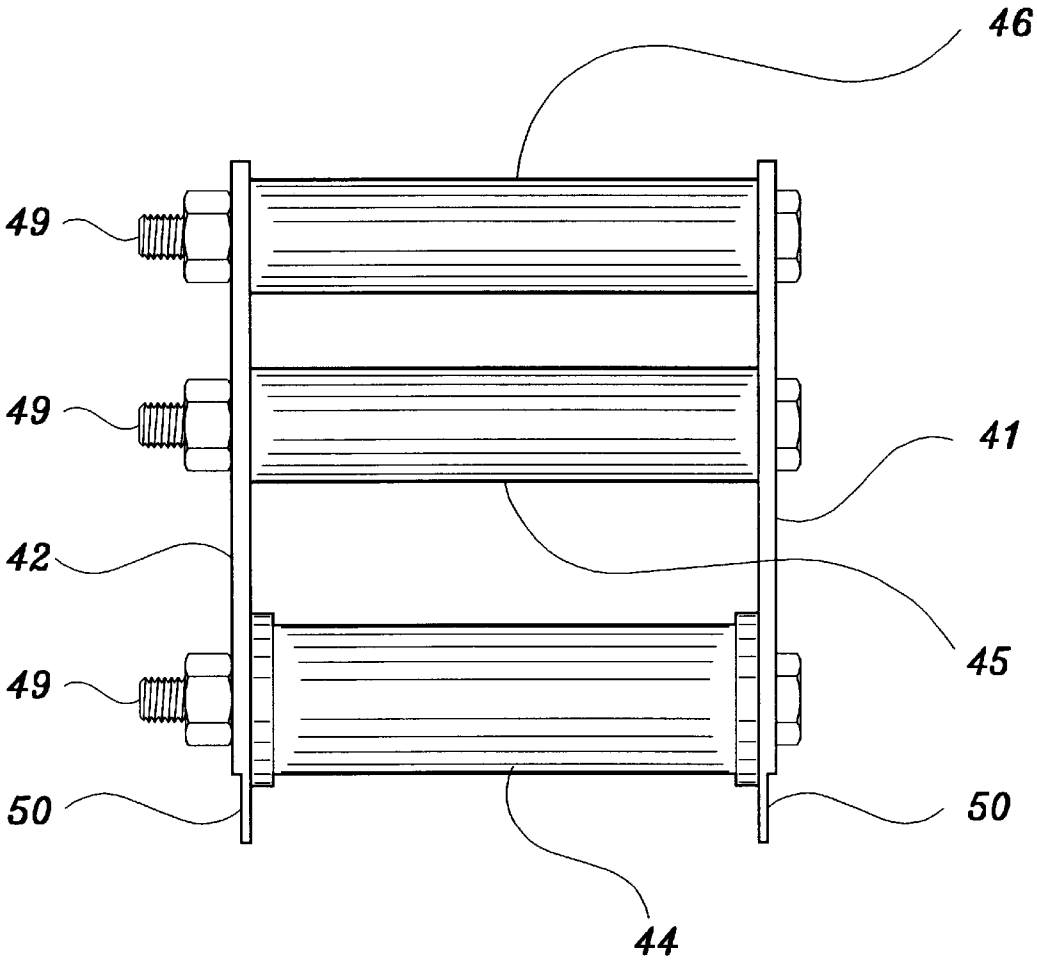
FIG. 10 is a rear side plan view of the plank top end installation tool.
Figure 11:
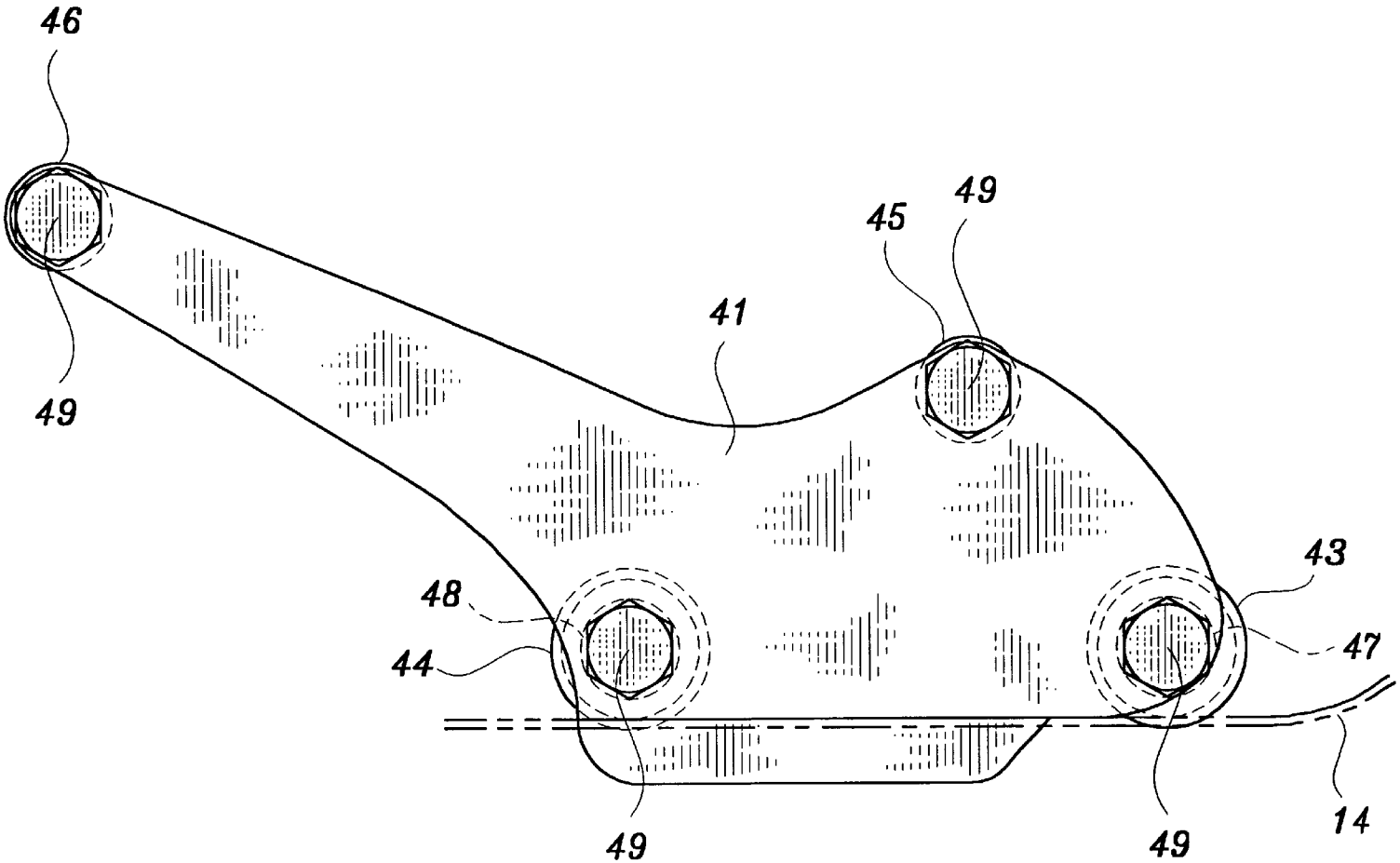
FIG. 11 is a right side plan view of the plank top end installation tool which is symmetrical with a right side plan view thereof with a flexible top plank material threaded thereunder.
Figure 12:
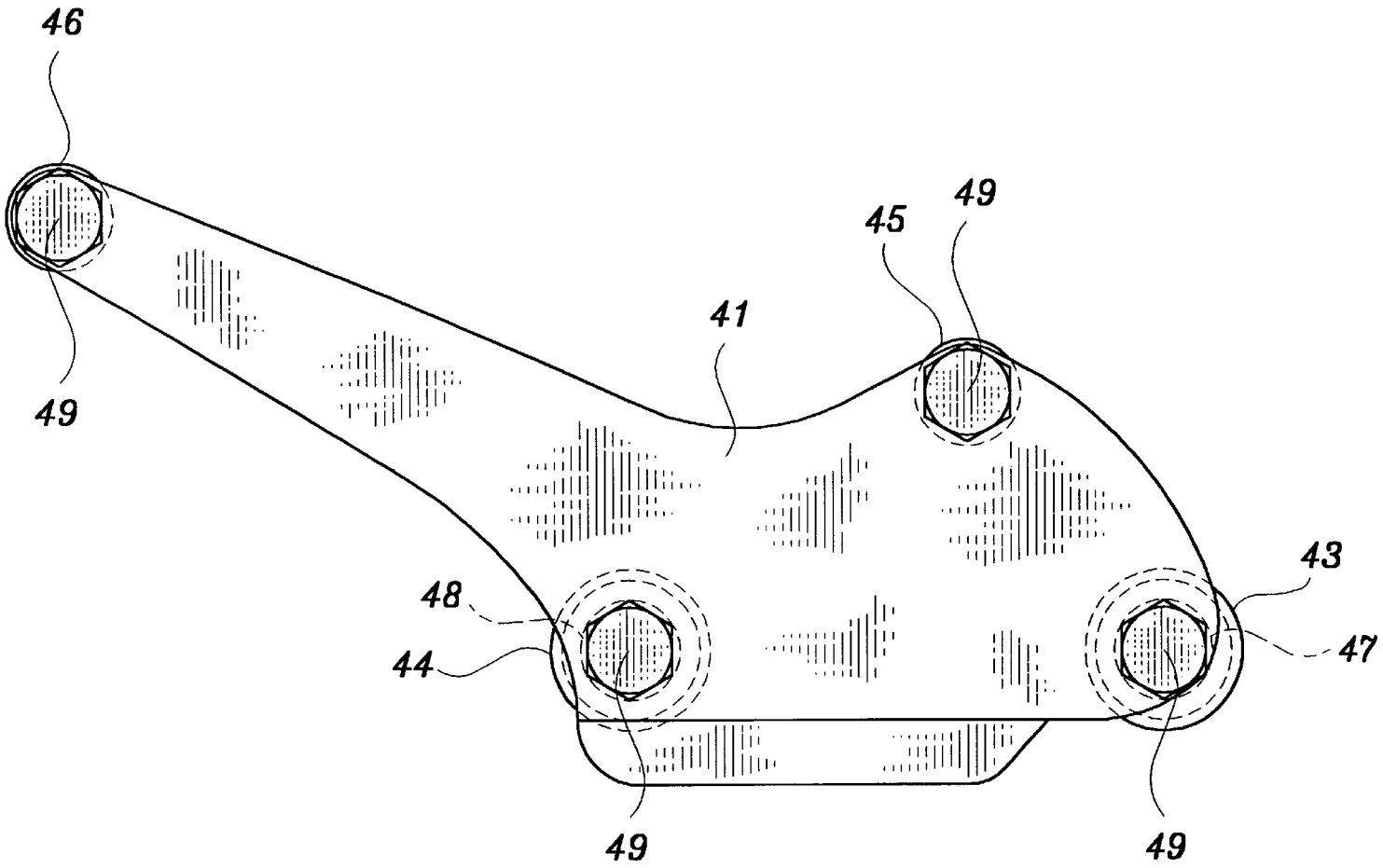
FIG. 12 is a right side plan view of the plank top end installation tool which is symmetrical with a right side plan view thereof.
Figure 13:
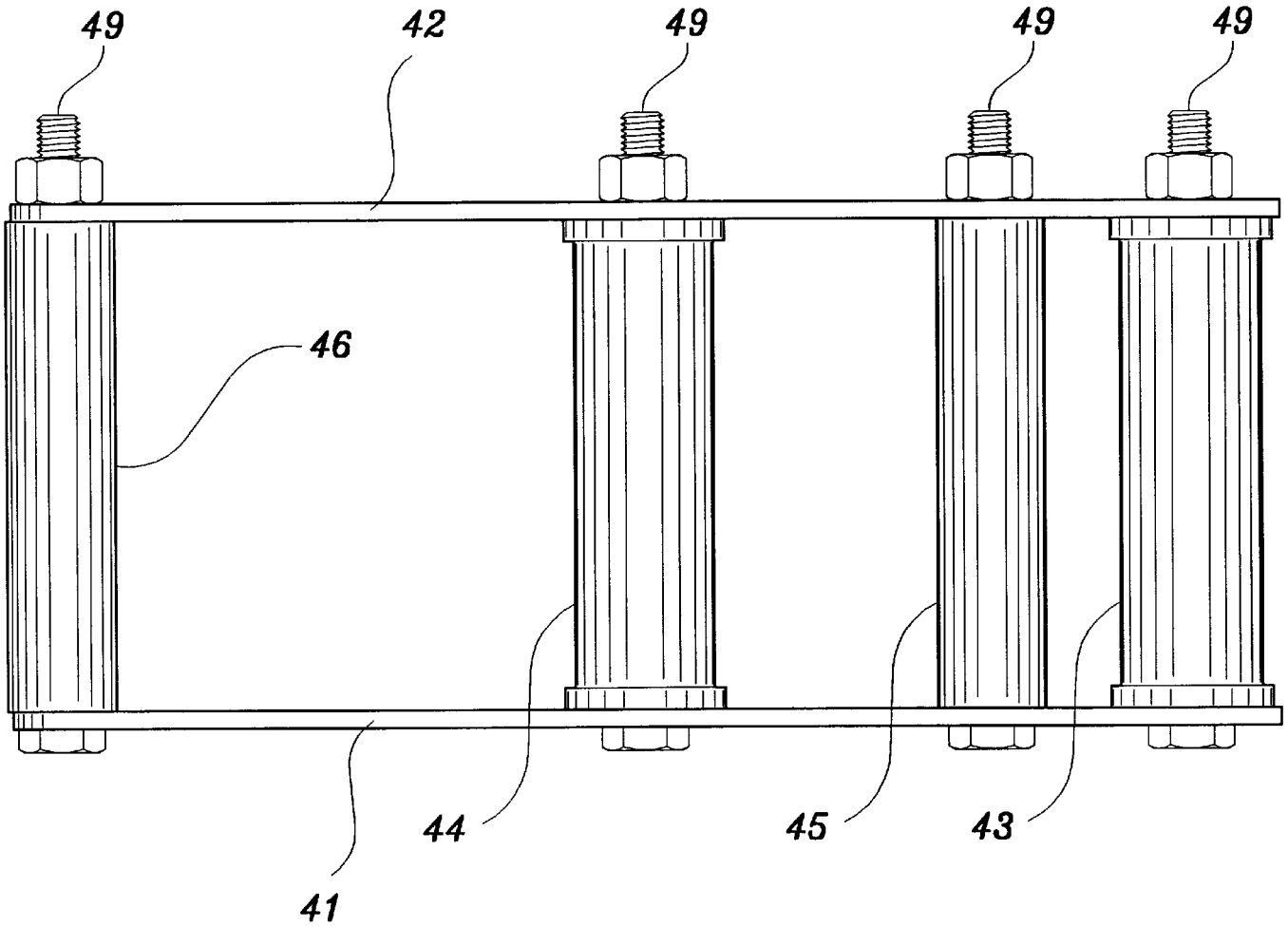
FIG. 13 is a top side plan view of the plank top end installation tool.
Figure 14:
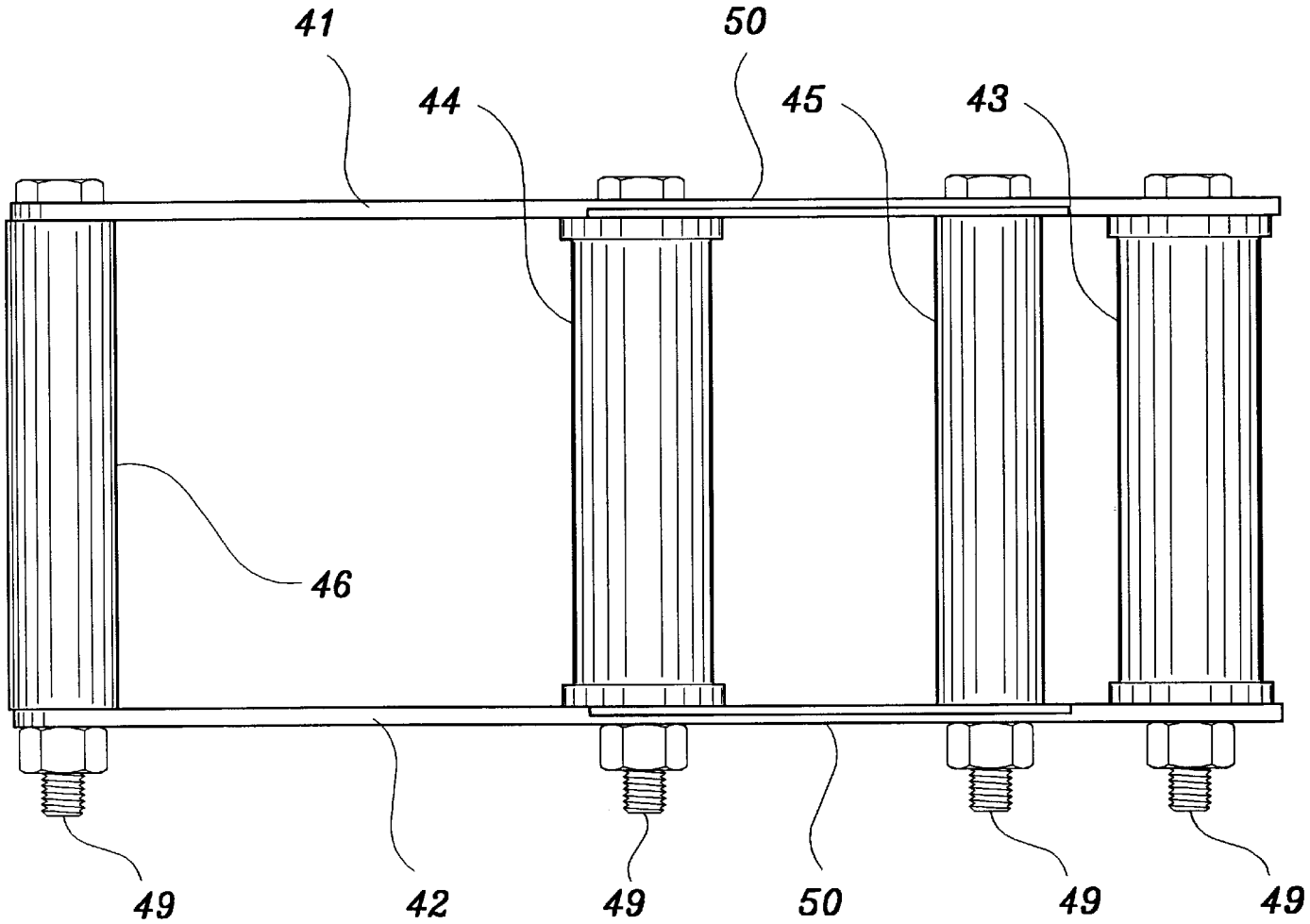
FIG. 14 is a bottom side plan view of the plank top end installation tool.
Figures 15, 16:
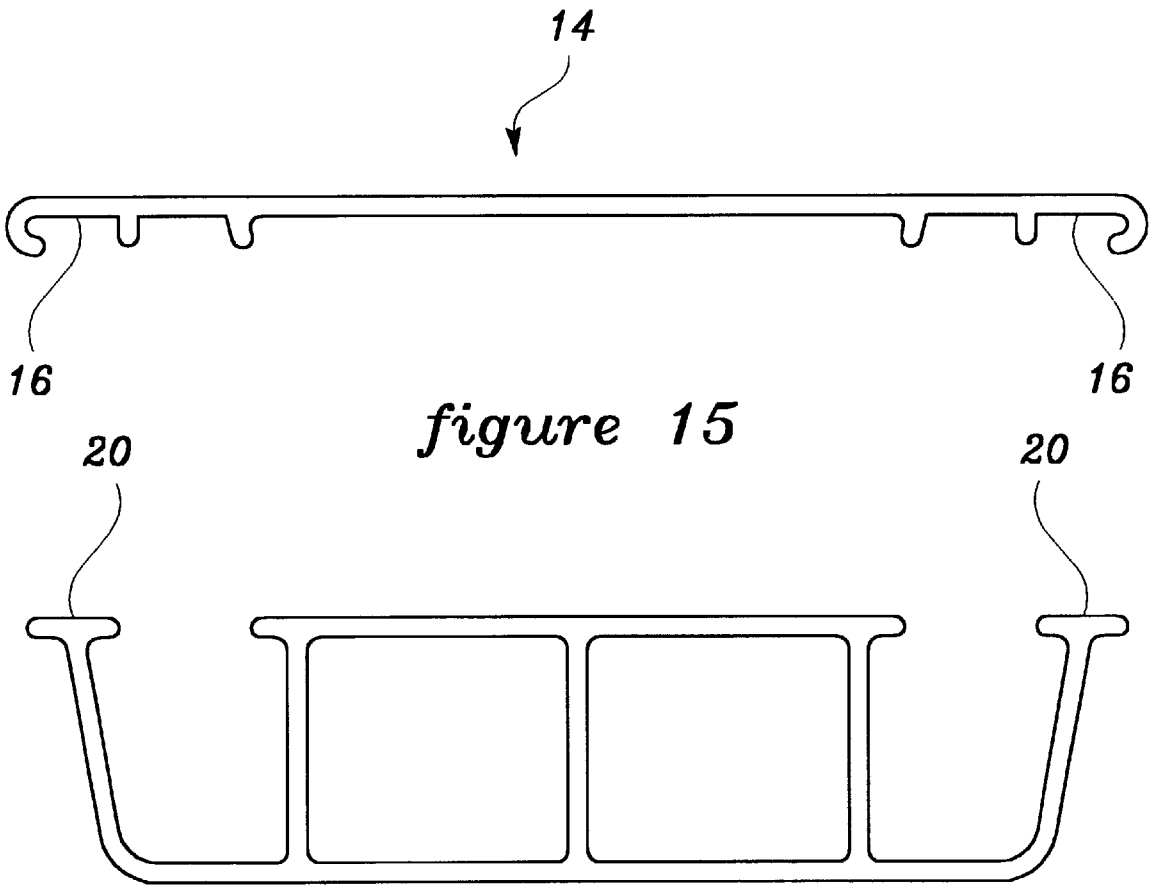
FIG. 15 is a cross section view of a flexible top plank known as "Teck Deck" which is manufactured by Heritage Vinyl Products.
FIG. 16 is a cross section view of a bottom plank known as "Teck Deck™" which is manufactured by Heritage Vinyl Products.

Referring now to the drawings, there is shown in FIGS. 1–7 a preferred embodiment of the plank top installation tool and in FIGS. 8–14 a preferred embodiment of the plank top end installation tool both of which form the apparatus of the present invention. FIGS. 15–16 show a cross-sectional view of the typical decking material with which the method and apparatus of the present art is used. The method and apparatus of the present art is particularly adapted for use in placing and securing a top plank 14 of decking material to the bottom plank 18 of said decking material without using hammers, mallets or other techniques which may damage the decking material. A unique feature of the present invention is its utilization of the shape and form of the top 14 and bottom 18 plank in such a way as to allow a moment arm of force created with a handle 27 to snap grooves 16 within the top plank 14 onto one or more ears 20 of the bottom plank 18. Generally, the aforesaid is accomplished with the installer using the apparatus while in a standing position. The plank top end installation tool 11 may require the installer to operate in a crouched or kneeling position in some situations. All component attachments, when necessary, are achieved with conventional fasteners such as screws, bolts, threads, pins, welds, adhesives or rivets as desired by the manufacturer of the art described.

Drawings 1–7 show a preferred embodiment of the plank top installation tool 10 comprising a roller and face plate yoke 21, a face plate 22, a front roller guide 23, a pressure roller 24, a front roller guide axle 25, a pressure roller axle 26, and a handle 27. The yoke 21 acts as the central housing upon which all parts attach directly or indirectly. It is of generally "U" shape in the horizontal plane with mounting holes for placement of said axles 25, 26 and said handle 27. The yolk 21 has a front, rear, top and bottom portion. Alternative embodiments of said yolk 21 may vary from a "U" shape and not affect the operation of said plank top installation tool 10, provided that the relative position of the pressure roller 24 and the face plate 24 are kept the same as herein described. Moreover, methods of mounting said axles 25, 26 and handle 27 other than with holes in said yolk 21 may be used without departing from the spirit of the present art.

In a preferred embodiment, the face plate 22 is of substantially flat form with one or more plate ears 28 extending upward to provide a pivoting attachment to the front portion of the yoke 21 via the front roller guide axle 26. Each of said plate ears 28 has a hole through which said roller guide axle 25 may be placed. The face plate 22 along with the front roller guide 23 is attached via the front roller guide axle 25 near the front portion of the yolk 21. The front roller guide axle 25 is removably mounted to the yolk 21 towards the front portion of the yolk 21. The front roller guide 23 is of substantially cylindrical shape and is located near the front portion of the yolk 21 and onto said front roller guide axle 25 between said plate ears 28. The front roller guide 23 is located in such a fashion that it is rotatable and capable of guiding said top plank 14 into and through said yolk 21. In a preferred embodiment, said front roller guide 23 contains one or more alignment grooves 30 which correspond and fit with the underside grooves 16 of the top plank 14. Alternative embodiments may forego use of a roller guide axle 25, plate ears 28, and pivoting attachment of the yoke 21 without departing from the spirit of the present art. Moreover, alternative embodiments may incorporate a front roller guide 23 which is not substantially cylindrical in shape and which does not rotate.

The bottommost portion of the face plate 22 comprises one or more alignment grooves 32 for proper alignment with and onto the ears 20 of the bottom plank 18. In a preferred embodiment, there are two of said grooves 32 that are of substantially inverted "L" cross sectional shape whereby the bottom plank ears 20 are capable of insertion and holding within said grooves 32. Alternative embodiments may have more or less grooves 32 which have a cross section of inverted "T" shape, "U" shape or an inverted tapered "U" shape, or any other shape which is capable of accepting and holding said bottom plank ears 20.

The front roller guide 23 acts to guide and align the flexible top plank material 14 under the pressure roller 24 via the one or more roller alignment grooves 30 contained on the front roller guide 23. In a preferred embodiment, the pressure roller 24 is of cylindrical shape and rotatably mounted toward the rear of the yolk 21, rearward of the front roller guide 23, and onto the pressure roller axle 26. The pressure roller 24 serves to press the top plank 14 onto the bottom plank 18 after the top plank 14 is fed over the front roller guide 23 when a downward force is placed on the handle 27. In a preferred embodiment, the pressure roller axle 26 is held in and through the yolk 21 via holes in the yolk 21 which are placed rearward of said front roller guide 23. The handle 27 attaches to the rear portion of the yoke 21 in order to provide a means by which pressure may be applied to the top plank material 14 through the pressure roller 24 while the installer is in a standing position. This is accomplished due to the fact that the alignment grooves 30 in the face plate 22 serve to hold the frontmost portion of the plank top installation tool 10 onto the ears 20 of the bottom plank 18 in order to provide a moment arm force onto the pressure roller 24. The face plate 22 does not raise from its contact and connection with the bottom plank 18 during use. Alternative embodiments may forego use of a pressure roller axle 26 without departing from the spirit of the present art. Moreover, alternative embodiments may incorporate a pressure roller 24 which is not substantially cylindrical in shape and which does not rotate.

The preferred embodiment of the top plank end installation tool 11 comprises a cylindrical front pressure roller 43 and a cylindrical rear roller 44, a right side plate 41 with one or more guide ears 50, a left side plate 42 with one or more guide ears 50, a force application front handle 45, a force application rear handle 46, a cylindrical front spacer bushing 47, and a cylindrical rear spacer bushing 48, all of which are secured together and to said plates 41,42 with fasteners 49 such as bolts or pins. Each of said plates 41,42 has a front, back, top and bottom portion with said guide ears 50 near the bottom portion of said plates 41,42. In a preferred embodiment, said bushings 47,48 are held in place by fasteners 49 such as bolts or pins which penetrate both the right side plate 41 and the left side plate 42 and serve as axles. Alternative embodiments may incorporate pins or dowels in place of said bolts or mount said components between and directly to said plates 41,42. Further alternative embodiments may forego the use of guide ears 50.

Said front roller 43 is mounted onto said front spacer bushing 47 and toward the front portion of said plates 41,42. Said rear roller 44 is mounted toward the rear of said plates 41,42 and the rear of said guide ears 50 and onto said rear spacer bushing 48. Each roller 43,44 is mounted over and allowed to roll on its respective bushing 47,48. Each of said rollers 43,44 are slightly shorter in length than the respective bushing 47,48 onto which it is mounted in order to ensure free rolling of said rollers 43,44. The placement of each of said rollers 43,44 is such that said guide ears 50 extend below the surface of said rollers 43,44 and serve to guide the top plank end installation tool 11 on the flexible top plank 14. Said rollers 43,44 place a user supplied force on said top plank 14 in order to push said top plank 14 onto said bottom plank 18 and snap or attach said top plank 14 into place with said bottom plank 18. It is important to note that although the rollers 43,44 are mounted on bushings 47,48 in a preferred embodiment, alternative embodiments may incorporate rollers 43,44 which simply bear upon the fasteners 49 or bolts which hold them and the side plates 41,42 together. Further alternative embodiments may incorporate rollers which are not cylindrical in shape and which do not rotate.

The force application front handle 45 is located near the front and top portion of said plates 41,42. Furthermore, The force application rear handle 46 is located near the rear and top portion of said plates 41,42. Alternative embodiments may place said handles 45,46 wherever they are most conveniently used by the installer.

The plank top end installation tool 11 with its placement of rollers 43,44, especially the front pressure roller 43, allows the last portions, generally a few inches, of plank top 14 to be secured to the bottom plank 18, especially when said planks 14, 18 are abutted to a wall or structure. It is important to note that the plank top end installation tool 11 is used in conjunction with the plank top installation tool 10 and usually after said plank top installation tool 10 in order to perform the method of the present art as further described.

The preferred method of plank top installation of the present art requires the user or installer to first use the plank top installation tool 10 to install most of the top plank 14 to the bottom plank 18 and then finish installing the ends of the top plank 14 with the plank top end installation tool 11. Alternative methods may use the plank top end installation tool 11 first then complete the installation with the plank top installation tool 10. When operating the plank top installation tool 10, the user or installer first places, aligns and secures the bottommost portion of the face plate 22 containing the alignment grooves 30 onto the interfacing portion of the bottom plank 18 containing the bottom plank ears 20. The alignment grooves 30 snap into place over said bottom plank ears 20 due to the fact that said ears 20 are flexible and pliable. As aforementioned, the shape of said alignment grooves 30 is such that said face plate 22 is held to said bottom plank 18 yet allowed to move linearly forward on said bottom plank 18 during the installation process.

After said face plate 22 is placed, the user or installer threads a flexible top plank 14 over the front roller guide 23 and under the pressure roller 24. With the top plank 14 threaded, the user then presses downward with the handle 27 and begins walking in a forward direction until the user approaches the end of the top plank 14. As the user walks, the top plank 14 hooked portions or grooves 16 are forcibly secured onto the extending ears 20 of the bottom plank 18 or bottom plank ears 20 via the force provided by the pressure roller 24. Pressure is provided by and onto the pressure roller 24 due to the fact that the unique configuration of the alignment grooves 30 in the face plate 22 serve to hold said face plate 22 onto the ears 20 of the bottom plank 18 and form a moment arm of force due to the force supplied by the handle 27. When the user reaches the end of said top plank 14, the user removes the face plate 22 from the bottom plank ears 20 and further removes the plank top installation tool 10 and then completes the installation with the plank top end installation tool 11.

The installation method of the present art is fully completed by use of the plank top end installation tool 11. In operation of the plank top end installation tool 11, the installer places the top plank end installation tool 10 onto the end of the top plank 14 which is still unplaced and unsecured with said bottom plank 18 by contacting said top plank 14 with the rollers 43,44. The installer then contacts the front pressure roller 43 and rear roller 44 with the unsecured top plank 14 end and aligns the guide ears 50 with and around the edges of said top plank 14 and presses downward on the front handle 45 and rear handle 46 while rolling forward to finish the top plank installation. The user supplied force on the force application front handle 45 and force application rear handle 46 serves to provide enough force onto said rollers 43,44 to secure the flexible top plank 14 onto the bottom plank 18. After the top plank 14 is fully placed, the user simply lifts the top plank end installation tool 11 off of the top plank 14 and the method of installation is complete.

As described, the art of the present method is shown and described along with the apparatus used to accomplish said method. The art of the present invention is drawn only to the method and apparatus shown and described and makes no claim to the configuration, shape or construction of the decking materials described.

From the foregoing description, those skilled in the art will appreciate that all objects of the present invention are realized. A method and apparatus for plank top installation for a deck is shown which is particularly adapted for operation with the "Teck Deck" system from Heritage Vinyl Products of Macon, Miss. The method and apparatus of this invention is able to provide the required force for pressing and securing a top plank onto a bottom plank of said decking materials without using hammers, mallets or other tools which may harm said decking materials.

Having described the invention in detail, those skilled in the art will appreciate that modifications may be made to the invention without departing from its spirit. Therefore, it is not intended that the scope of the invention be limited to the specific embodiments illustrated and described. Rather it is intended that the scope of this invention be determined by the appended claims and their equivalents.

What is claimed is:

1. The combination of an apparatus for installing a top plank having at least one groove onto a bottom plank having at least one plank ear and said top and bottom planks, the combination comprising:

a yolk, having a front, rear, top and bottom portion; and a face plate mounted near said front portion of said yolk and having at least one alignment groove below said bottom portion of said yolk which is capable of attachment onto the at least one plank ears of the bottom plank, a front roller guide mounted above said face plate and near said front portion of said yolk whereby the top plank may rest and be threaded over said roller guide near said top portion of said yolk; and a pressure roller mounted near said rear portion of said yolk whereby the top plank may be threaded under said pressure roller near said bottom portion of said yolk; and a handle attached to said yolk near said rear portion, whereby when a force is applied to said handle toward said bottom portion of said yolk, a force is created onto said pressure roller and thereby onto the top plank due to a moment arm of force between said face plate and said handle, thereby resulting in the attachment of the grooves of the top plank onto and with the plank ears of the bottom plank.

2. The combination as set forth in claim 1 further comprising:

at least one roller groove on said front roller guide, whereby said roller grooves serve to align and guide the grooves of the top plank.

3. The combination as set forth in claim 2 further comprising:

at least one plate ear mounted onto said face plate opposite said alignment grooves, whereby said face plate is able to pivotally mount to said yolk.

4. The combination as set forth in claim 3 further comprising:

a front roller guide axle mounted through, said yoke, said front roller guide and said plate ears whereby said face plate may pivot on and said front roller guide may rotate on said front roller guide axle; and a pressure roller axle mounted through, said yoke and said pressure roller whereby said pressure roller may rotate on said roller axle.

5. The combination as set forth in claim 1 further comprising:

at least one plate ear mounted onto said face plate opposite said alignment grooves, whereby said face plate is able to pivotally mount to said yolk.

6. The combination as set forth in claim 4 further comprising:

a front roller guide axle mounted through, said yoke, said front roller guide and said plate ears whereby said face plate may pivot on and said front roller guide may rotate on said front roller guide axle.

7. The combination as set forth in claim 6 further comprising:

a pressure roller axle mounted through, said yoke and said pressure roller whereby said pressure roller may rotate on said roller axle.

8. The combination as set forth in claim 1 further comprising:

a pressure roller axle mounted through, said yoke and said pressure roller whereby said said pressure roller may rotate on said roller axle.

9. The combination of an apparatus for installing a top plank end having at least one groove onto a bottom plank end having at least one plank ear and said top and bottom planks, the combination comprising:

a right side plate and a left side plate having a top, bottom, front and rear and at least one guide ear extending below said bottom of said plates; and a front pressure roller mounted and connected between said right and left side plates near said front and said bottom of said plates; and a rear roller mounted and connected between said right and left side plates near said rear and said bottom of said plates; and a force application front handle mounted and connected between said right and left side plates near said front and said top of said plates; and a force application rear handle mounted and connected between said right and left side plates near said rear and said top of said plates;

whereby the top plank end is inserted between said ears of said right and left side plates such that a force placed upon said front and rear handle causes said front and rear rollers to force the grooves of the top plank to attach onto and with the plank ears of the bottom plank.

10. The combination as set forth in claim 9 further comprising:

a front spacer-bushing between said right side plate and said left side plate and within said front pressure roller, whereby said front pressure roller may roll upon said front spacer bushing.

11. The combination as set forth in claim 10 further comprising:

a rear spacer bushing between said right side plate and said left side plate and within said rear roller, whereby said rear roller may roll upon said rear spacer bushing.

12. The combination as set forth in claim 9 further comprising:

a rear spacer bushing between said right side plate and said left side plate and within said rear roller, whereby said rear roller may roll upon said rear spacer bushing.

13. A method for installing a top plank having at least one groove onto a bottom plank having at least one plank ear, comprising:

affixing at least one alignment groove of a face plate of a plank top installation tool onto at least one of the plank ears of the bottom plank; and threading the top plank over a front roller guide and under a pressure roller of said plank top installation tool; and pressing downward on a handle of said plank top installation tool toward the bottom plank; and moving said plank top installation tool forward until said plank top installation tool is substantially near an end of the bottom or top plank, whereby the grooves of the top plank substantially attach onto and with the plank ears of the bottom plank; and removing said plank top installation tool from the bottom and top plank.

14. The method for installing a top plank having at least one groove onto a bottom plank having at least one plank ear as defined in claim 13, said method further comprising:

placing a front pressure roller and a rear roller of a plank top end installation tool onto the top plank of any substantially unattached portion of the top and bottom plank; and pressing downward on a force application front handle and a force application rear handle of said plank top end installation tool toward said bottom plank; and moving said plank top end installation tool forward until the grooves of said top plank substantially attach onto and with all of the plank ears of said bottom plank.

15. The method for installing a top plank having at least one groove onto a bottom plank having at least one plank ear as defined in claim 14, said method further comprising:

aligning the top plank between at least two guide ears of said plank top end installation tool.

* * * * *